US006328203B1

(12) United States Patent
Tedford, Jr.

(10) Patent No.: US 6,328,203 B1
(45) Date of Patent: Dec. 11, 2001

(54) OPENING FEATURE FOR BEVERAGE CONTAINER

(75) Inventor: Richard A. Tedford, Jr., Loveland, OH (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/848,359

(22) Filed: May 4, 2001

(51) Int. Cl.[7] ..... B65D 17/347

(52) U.S. Cl. ..... 229/123.2; 53/133.3; 53/133.8; 220/270; 229/125.15; 229/160.2; 229/206; 229/238

(58) Field of Search ..... 229/123.2, 123.3, 229/125.15, 160.2, 206, 238, 242; 220/270; 53/133.3, 133.8, 484

(56) References Cited

U.S. PATENT DOCUMENTS 3,471,351 * 10/1969 Fuchs ..... 53/133.3
4,403,710 * 9/1983 Hirota et al. ..... 220/270
4,513,876 * 4/1985 Buchner ..... 220/270
4,770,325 * 9/1988 Gordon et al. ..... 229/125.15
4,796,760 * 1/1989 Rausing ..... 229/238
4,828,138 * 5/1989 Andersson ..... 220/270
4,877,149 * 10/1989 Kodama et al. ..... 220/270
5,125,529 * 6/1992 Torterofot ..... 220/270
5,303,838 * 4/1994 Luch et al. ..... 220/270
5,653,383 * 8/1997 Adachi et al. ..... 229/125.15
6,106,757 * 8/2000 Ohlsson et al. ..... 220/270

* cited by examiner

*Primary Examiner*—Gary E. Elkins
(74) *Attorney, Agent, or Firm*—Stewart L. Gitler; Melvin D. Fletcher

(57) ABSTRACT

An opening feature for a beverage container with at least one extrusion over void area, a pull tab affixed to the package in the perimeter of the void area, and a perforation of the package film in the perimeter of the pull tab to allow for a simple low cost structure.

11 Claims, 1 Drawing Sheet

OPENING FEATURE FOR BEVERAGE CONTAINER

BACKGROUND OF THE INVENTION

The invention is directed to an opening feature for a beverage container which includes an extrusion over void (EOV) area in the location of the package web corresponding to the top of a finished container, a pull tab adhesively fixed to the exterior of the package with the extrusion over void perimeter, and a perforation of the package laminate within the perimeter of the pull tab applied subsequent to application of the pull tab to the extrusion over void (EOV).

Prior attempts at opening features for packages or containers have all been deficient in their design.

U.S. Pat. No. 4,838,429, Fabisiewicz et al, discloses a flexible thermoplastic pouch with a tear strip. The patent relies on an imperforate sidewall for barrier protection.

U.S. Pat. No. 3,158,491, Farrell et al, discloses a food container with a pull tab. The structure includes a half cut opening that requires high opening forces.

U.S. Pat. 3,187,983, Mendoza, discloses a cellophane wrapper pull tab that does not provide any access through the sidewall.

U.S. Pat. No. 1,018,464, Wiese, discloses a tearing strip for tin foil packages. The structure uses an added tear strip that would cause a leak in a beverage application. In contrast to these teachings, an inventive aspect is that the sidewall is completely cut for easy opening.

U.S. Pat. Nos. 4,739,879; 4,420,080; 4,610,357; and 4,651,874, Nakamura, disclose a heat sealable dispenser container having a through hole punched in the web prior to label application that allows product migration into the paper edge in a paper container. In contrast, the invention, as described herein, includes paper edge protection afforded by the seal of the label to the extrusion over void area.

The invention as described, has an object thereof, the provision of a low cost opening features.

It is a further object to provide a low cost opening feature with a sidewall that is completely cut for ease of opening.

SUMMARY OF THE INVENTION

The opening feature for a beverage container has an extrusion over void area on the top of a finished package. A pull tab is adhesively fixed to the exterior of the package within the extrusion over void area. Finally, a perforation of the package laminate is provided within the perimeter of the pull tab and is applied subsequent to application of the pull tab.

DETAILED DESCRIPTION OF THE INVENTION

Figure 1:
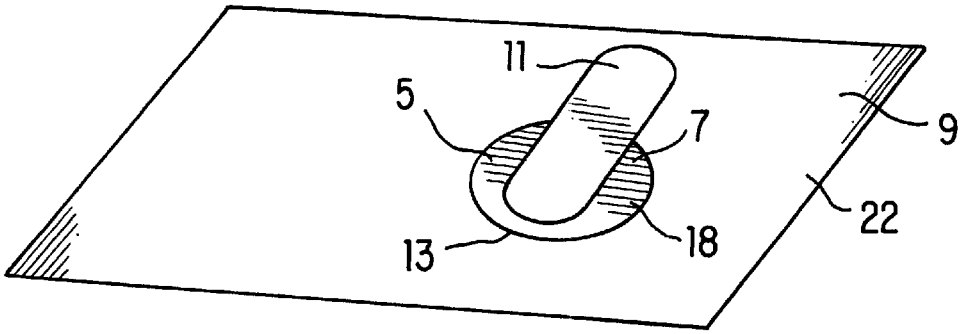
FIG. 1 is a top perspective view of a package top having an opening feature as embodied in the invention.
Figure 2:
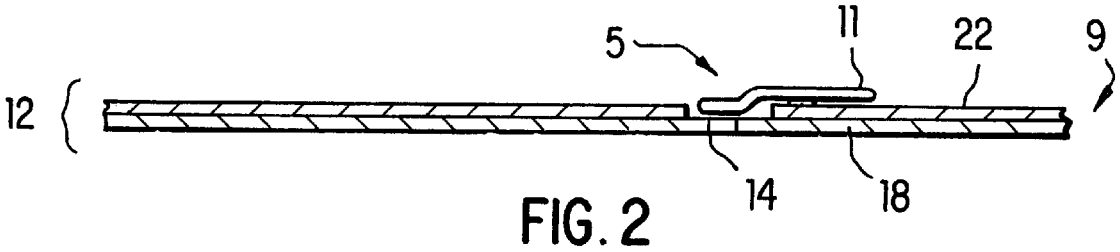
FIG. 2 is a cross-sectional view of a package top laminate structure having an opening feature as embodied in the invention.
Figure 3:
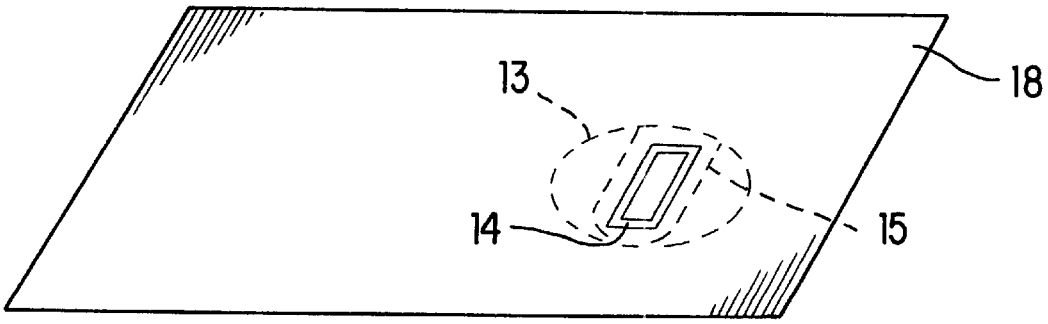
FIG. 3 is a underside view of a package top having an opening feature as embodied in the invention.

The opening feature 5, embodying the invention, includes an extrusion over void area 7 in the package web 9 corresponding to the top of a finished beverage container. A pull tab 11, is adhesively fixed to the exterior of the package within the extrusion over void perimeter 13, and a perforation 14 of the package laminate 12 within the perimeter 15 of the pull tab 11, applied subsequent to the application of the pull tab 11 to the extrusion over void area 7.

The extrusion over void area has a film ranging in thickness from 1 to 7 mils thereunder. Metallized film or aluminum foil 18 is provided as the film in a preferred embodiment of the laminate structure. The paper or paperboard layer 22 has a thickness ranging from 4 to 28 mils, and is not present in the void area 7.

Pull tab materials can be made of aluminum foil, oriented polypropylene, metallized polypropylene, polyester, or polyolefins. They are affixed to the exterior of the package through thermoplastic adhesion, hot melt adhesion, pressure sensitive adhesive, or with glue. Pull tab thicknesses range from 1 to 5 mils depending on the materials used and the resistance to tear of the materials being covered. The pull tab 11 functions as a barrier to prevent oxygen and liquid transport through the perforation.

The perforation 14 can be applied through selective depth mechanical die cutting or by selective depth laser cutting. By applying the perforation 14 after affixing the pull tab 11, the package contents are protected from direct contact with the pull tab material. The perforation 14 must not breach the pull tab 11 in order to preserve package barrier properties. In a preferred embodiment, the laser cuts through the aluminum foil 18 in the extrusion over void 7 area, but is of insufficient strength to pierce the pull tab 11.

The use of an extrusion over void 7 area greatly simplifies the production process. The pull tab 11 is contained in the extrusion over void perimeter 13 and the pull tab 11 is of lower caliper than the paper component 22 of the structure, then the entire patching (pull tab application) and perforation process can be done in a roll to roll manufacturing operation prior to delivery to the customer. The method generates a local area of increased thickness which prevents rewinding.

The production process can also be customized at low cost. With the extrusion over void present for raw edge protection, a pull tab applicator and die cut operation can be added to the beverage filler at lower cost than a four-step process used by many producers. For the case of aseptic webs, it is desirable to manufacture the web with the extrusion over void and pull tab attached for delivery to the customer while laser perforation is applied after the sterilization process in the filler. This maintains sterility without risk of hydrogen peroxide residual in the perforation area. For customers which desire additional features or reclosure which necessitate a pull tab 11 extending outside the extrusion over voice perimeter, the pull tab application can be done on a filling machine with an inexpensive label applicator.

The foregoing description relates to preferred embodiments of the present invention, and numerous changes and modifications may be made therein without departing from the spirit and scope of the invention as defined in the claims.

What is claimed is:

1. An opening feature for a container comprising:

a) a laminate package structure comprising a substrate and a film extruded thereon, and having an extrusion over void area in the substrate on at least one panel of the container;

b) a pull tab adhesively affixed to the film in a perimeter of the extrusion over void area; and c) a perforation of the film within a perimeter of the adhesively affixed pull tab, the perforation being applied subsequent to application of the pull tab onto the films.

2. The opening feature as claimed in claim 1, wherein the film is a matallized foil or aluminum foil.

3. The opening feature as claimed in claim 1, wherein the film layer ranges from 1 to 7 mils.

4. The opening feature as claimed in claim 1, wherein the substrate is paper or paperboard.

5. The opening feature as claimed in claim 1, wherein the substrate has a thickness ranging from 4 to 28 mils.

6. The opening feature as claimed in claim 1, wherein the pull tab is aluminum foil, oriented polypropylene, metallized polypropylene, polyester or polyolefin.

7. The opening feature as claimed in claim 1, wherein the pull tab is affixed to the film through thermoplastic adhesion, hot melt adhesion, pressure sensitive adhesives, or glue.

8. The opening feature as claimed in claim 1, wherein the pull tab has a thickness ranging from 1 to 5 mils.

9. The opening feature as claimed in claim 1, wherein the perforation is applied through selective depth mechanical die cutting or selective depth laser cutting.

10. A process of producing an opening feature as claimed in claim 1 comprising the steps of:

a) manufacturing the laminate package structure with an extrusion over void area on at least the one panel of the container;

b) affixing a pull tab with a perimeter of the extrusion over void area; and c) perforating the film with a perimeter of the pull tab.

11. The process of producing an opening feature as claimed in claim 10, wherein the container is sterilized in a filler prior to the perforating of the film.

* * * * *